US010542791B2

(12) United States Patent
Cifo Garcia

(10) Patent No.: US 10,542,791 B2
(45) Date of Patent: Jan. 28, 2020

(54) WEIGHTING DEVICE FOR FOOTWEAR

(71) Applicant: CIFOSPORT LICENSING, S.L., Barcelona (ES)

(72) Inventor: Domingo Cifo Garcia, Dosrius (ES)

(73) Assignee: CIFOSPORT LICENSING, S.L., Barcelona (ES)

( * ) Notice: Subject to any disclaimer, the term of this patent is extended or adjusted under 35 U.S.C. 154(b) by 421 days.

(21) Appl. No.: 14/776,658

(22) PCT Filed: Mar. 13, 2014

(86) PCT No.: PCT/ES2014/070181
§ 371 (c)(1),
(2) Date: Sep. 14, 2015

(87) PCT Pub. No.: WO2014/140400
PCT Pub. Date: Sep. 18, 2014

(65) Prior Publication Data

US 2016/0029742 A1 Feb. 4, 2016

(30) Foreign Application Priority Data

Mar. 14, 2013 (ES) ..... U201300247

(51) Int. Cl.
*A43B 19/00* (2006.01)
*A43B 3/00* (2006.01)
(Continued)

(52) U.S. Cl.
CPC ..... *A43B 19/005* (2013.01); *A43B 3/0031* (2013.01); *A63B 21/065* (2013.01);
(Continued)

(58) Field of Classification Search
CPC ..... A43B 19/005; A43B 3/0031; A43B 23/24; A63B 21/065
(Continued)

(56) References Cited

U.S. PATENT DOCUMENTS 3,114,982 A 12/1963 McGowan
3,334,898 A 8/1967 McCrory et al.
(Continued)

FOREIGN PATENT DOCUMENTS

CN 2772550 Y 4/2006
EP 2055234 A1 5/2009
(Continued)

OTHER PUBLICATIONS

Spanish version of the International Search Report and Written Opinion for PCT application No. PCT/ES2014/070181 Issued by the Spanish Patent and Trademark Office on Apr. 15, 2014, 8 pages, Madrid Spain.
(Continued)

*Primary Examiner* — Marie D Bays
(74) *Attorney, Agent, or Firm* — Peter B. Scull; HDC IP Law LLP

(57) ABSTRACT

The invention relates to a weighting device for footwear, applicable in footwear suitable for practicing sports and/or for rehabilitation therapy, said device comprising a plate (1) of weighted material, preferably quadrangular and with a curved or angular configuration suitable for applying to the area of the instep of the footwear, a receptacle suitable for containing said plate (1), and means for attaching the device to the footwear to be weighted.

6 Claims, 4 Drawing Sheets

(51) Int. Cl.
*A63B 21/065* (2006.01)
*A63B 23/04* (2006.01)
*A63B 21/00* (2006.01)

(52) U.S. Cl.
CPC ..... *A63B 21/4015* (2015.10); *A63B 21/4025* (2015.10); *A63B 23/04* (2013.01)

(58) Field of Classification Search
USPC ..... 36/132, 136, 72 R
See application file for complete search history.

(56) References Cited

U.S. PATENT DOCUMENTS 4,231,170 A 11/1980 Griswold
4,247,097 A 1/1981 Schwartz
4,258,914 A * 3/1981 Lalli ..... A63B 21/065 224/219
4,322,072 A 3/1982 White
4,355,801 A 10/1982 Thomsen
4,458,432 A 7/1984 Stempski
4,507,882 A 4/1985 Harrell
4,536,975 A * 8/1985 Harrell ..... A43B 1/0072 2/245
4,556,215 A 12/1985 Tarbox
4,575,075 A 3/1986 Tarbox et al.
4,632,389 A 12/1986 Moss
4,777,743 A 10/1988 Roehrig, Jr.
4,823,426 A * 4/1989 Bragga ..... A47L 23/00 15/210.1
4,838,546 A 6/1989 Winston
5,127,891 A 7/1992 Winston
5,265,353 A * 11/1993 Marega ..... A43B 5/0405 36/117.6
5,311,679 A * 5/1994 Birch, Sr. ..... A43B 3/0031 2/919
5,459,947 A * 10/1995 Lasher ..... A43B 23/26 24/306
5,542,896 A 8/1996 Qaiesi et al.
5,632,709 A 5/1997 Walsh
5,683,335 A 11/1997 Groves et al.
5,728,032 A * 3/1998 Glass ..... A43B 5/00 36/132
5,868,652 A 2/1999 Spletzer
5,893,223 A * 4/1999 Glass ..... A43B 5/00 36/132
6,010,438 A 1/2000 Fitzgerald
6,039,677 A 3/2000 Spletzer
6,357,147 B1 * 3/2002 Darley ..... G01P 15/08 36/132
6,742,288 B2 * 6/2004 Choi ..... A43B 3/0031 36/103
7,000,337 B2 * 2/2006 Harrington ..... A43B 5/00 36/132
7,063,650 B1 * 6/2006 Beausoleil ..... A63B 21/0605 482/105
7,152,286 B2 * 12/2006 Rooney ..... A43B 1/0054 24/712.6
7,497,035 B2 3/2009 Kos et al.
7,559,127 B2 * 7/2009 Rooney ..... A43B 1/0054 24/712
7,833,137 B2 * 11/2010 Garnuette ..... A63B 21/06 36/132
9,009,992 B2 * 4/2015 Baker ..... A43B 5/025 36/133
2003/0192198 A1 10/2003 Wright
2004/0035025 A1 * 2/2004 Choi ..... A43B 3/0031 36/132
2005/0224672 A1 10/2005 Butt et al.
2005/0252042 A1 * 11/2005 Harrington ..... A43B 5/00 36/132
2007/0089322 A1 * 4/2007 Rooney ..... A43B 1/0054 36/136
2008/0248932 A1 * 10/2008 Geritano ..... A63B 21/065 482/105
2010/0050477 A1 3/2010 Zeek
2010/0192419 A1 8/2010 Jack
2010/0210428 A1 8/2010 Garnuette
2011/0009713 A1 * 1/2011 Feinberg ..... A61B 5/0205 600/301
2012/0028766 A1 2/2012 Zeek
2012/0028767 A1 2/2012 Zeek
2013/0008058 A1 * 1/2013 Jasmine ..... A43B 3/0005 36/136
2014/0200412 A1 7/2014 Martinez et al.
2015/0264997 A1 9/2015 Myles
2016/0029742 A1 * 2/2016 Cifo Garcia ..... A43B 19/005 36/132
2016/0345656 A1 12/2016 Ramirez, II
2016/0375334 A1 12/2016 Ragen
2017/0106225 A1 4/2017 Borés Cifo
2018/0326246 A1 11/2018 Borés Cifo

FOREIGN PATENT DOCUMENTS

ES 269613 U 8/1983
ES 1046537 U 1/2001
ES 1079084 U 4/2013
GB 2139103 A 11/1984

OTHER PUBLICATIONS

English Translation of the International Search Report and Written Opinion for PCT application No. PCT/E52014/070181 issued by the Spanish Patent and Trademark Office on Apr. 15, 2014, 9 pages, Madrid Spain.
Extended European Search Report for Application No. EP15382511 issued by the European Patent Office, dated Mar. 30, 2016, 8 pages, Munich, Germany.

* cited by examiner

WEIGHTING DEVICE FOR FOOTWEAR

OBJECT OF THE INVENTION

The present invention relates to a weighting device for footwear, applicable in footwear suitable for practising sports training and/or rehabilitation therapies.

This device has constructive particularities intended to allow weighting of footwear and to ensure immobilization of the device on the instep area, avoiding compressive stresses and possible rashes on the user's skin.

FIELD OF APPLICATION OF THE INVENTION

This weighting device is applicable in any type of footwear suitable both for practising sports training, for improving performance and increasing the athlete's strength and speed, and for practising rehabilitation therapies.

BACKGROUND OF THE INVENTION

Currently, it is common the use of weights and weighted garments for sports training and even for performing orthopaedic or rehabilitation treatments.

Thus, for example, the utility model 269613 discloses a weighted bracelet for sports training and orthopaedic use comprising a band made of a flexible material having a number of pockets suitable for receiving and containing a high specific weight material, such bracelet having engaging means for wearing it around the user's wrist or ankle.

The use of such types of bracelets, especially when they are used for sports training, has the disadvantage that they are gradually displaced alternately in a longitudinal direction on the user's limb, which is particularly uncomfortable and may even produce rashes on the user's skin.

The utility model U 200001586 discloses a weighted vest for sports training and for rehabilitation which consists basically of two rectangular pieces, a front one and a rear one, attached to each other by means of upper braces and lateral attaching means, each of said rectangular pieces consisting of a series of parallel strips arranged in an upright position inside of which sheets made of a heavy malleable material are provided.

This type of vest may be appropriate for certain trainings and rehabilitations but it does not present specific features for applying the weight on the user's feet and for performing tasks of both training and rehabilitation such as for the ankle, since the load is carried basically on the user's shoulders and spine, which may be inconvenient for people with ailments in these areas.

SUMMARY OF THE INVENTION

In order to overcome the disadvantages of the cited prior art, the weighting device for footwear object of the present invention has been devised which, in addition of being very simple in construction, it has adequate structural features suitable to be applied in any practical footwear used for practising sports training and/or rehabilitation therapies.

One of the objects of the invention is to ensure the immobilization of the weighting device on the area of the instep of the footwear, being placed externally thereon, preventing discomfort and rashes on the user's skin.

A further object of the invention is to allow the application of the weighting device on footwear normally used by the user such that she/he can continue to enjoy the comfort provided by her/his usual footwear without the need for acquiring weighted garments or for orthopaedic use for temporary application. Another object of the invention is to provide the weighting device with means for attaching to the footwear to be weighted so that the weighting device can be positioned or withdrawn as required depending on the exercise or therapy to be performed.

For this purpose, and according to the invention, this footwear device comprises a plate made of a heavy material, preferably quadrangular and having a curved or angular shape suitable for resting on the area of the instep of the footwear; a flexible receptacle provided with a suitable mouth for arranging said plate therein; and means for attaching the device to the footwear to be weighted.

In one embodiment of the invention, said receptacle consists of a flexible bag.

The curved or angular shape of the plate made of a heavy material ensures that it rests with its concave or inner surface on the outer surface of the footwear, in the instep area, which contributes to the immobilization of the weighting device on said area, avoiding continuous movements thereof.

In one embodiment of the invention, the means for attaching the weighting device to the footwear comprise: a strap having one end attached to the flexible bag and a free end; and adjustable closure means arranged at the free end of the strap and at the bag itself; said strap being of a suitable length to form a loop around the bag and to wrap a portion of the footwear, so that in a position of use, the strap itself establishes the closure of the bag mouth, preventing the plate of heavy material housed therein from getting out or being released.

In one variant of embodiment of the invention, the receptacle for receiving the plate of heavy material comprises a semirigid casing, inside of which the heavy material is arranged and a releasable mounting base suitable for wrapping on a portion of the footwear and engaging the casing, such that said releasable mounting base form means for attaching the device to the footwear to be weighted.

With this embodiment, the releasable mounting base can remain attached to the footwear and assembling and disassembling of the casing that is intended for receiving the weighting plate therein can be carried out as required.

In this embodiment, the casing and the releasable mounting base are provided with complementary coupling and attaching means in one coupling position at two opposite ends thereof.

The releasable mounting base has a curved outer surface such that it adapts to the area of the instep of the footwear, and it comprises lateral recesses, formed between two opposite ends carrying the coupling and attaching means, defining in said releasable mounting base an intermediate portion narrower than the opposite ends of said base.

Said narrower intermediate portion is suitable for allowing the base to be attached by means of the footwear laces themselves, said base being immobilized both from lateral movement and from longitudinal movement.

DESCRIPTION OF THE FIGURES

For completeness of the description made herein and in order to facilitate the understanding of the characteristics of the invention, the present specification is accompanied by a set of drawings in which, with an illustrative and non-limiting character, the following has been depicted.

PREFERRED EMBODIMENT OF THE INVENTION

As shown in the accompanying figures, the weighting device for footwear of the invention comprises a plate (1) made of a heavy material, in this case of metal, said plate (1) having a quadrangular and laterally curved shape.

Figure 1:
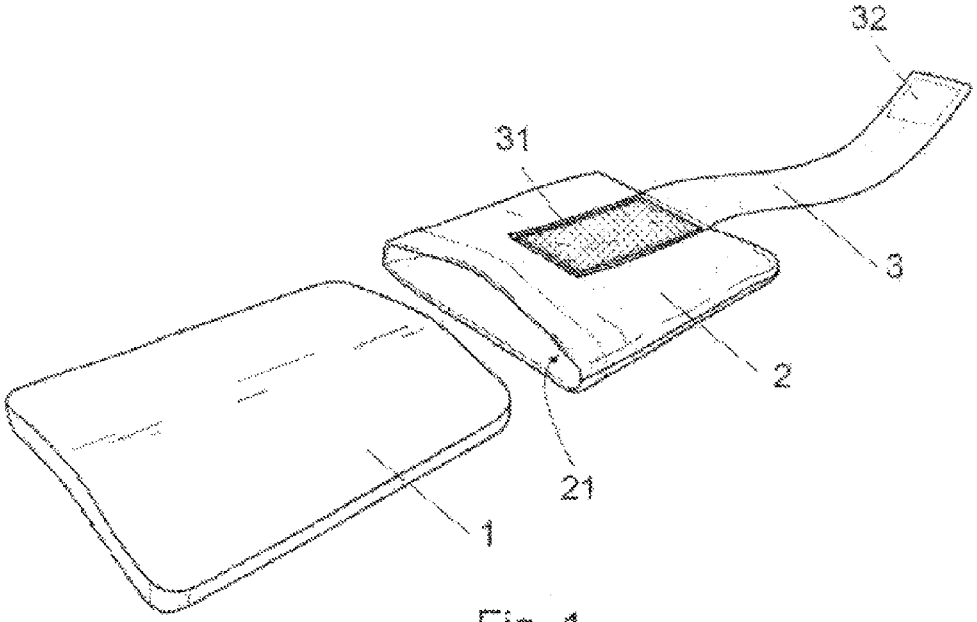
FIG. 1 shows a perspective view of an exemplary embodiment of the weighting device for footwear according to the invention in which the plate made of heavy material is shown withdrawn from the receptacle, in this example consisting of a flexible bag, having means for attaching the device to the footwear.
Figure 2:
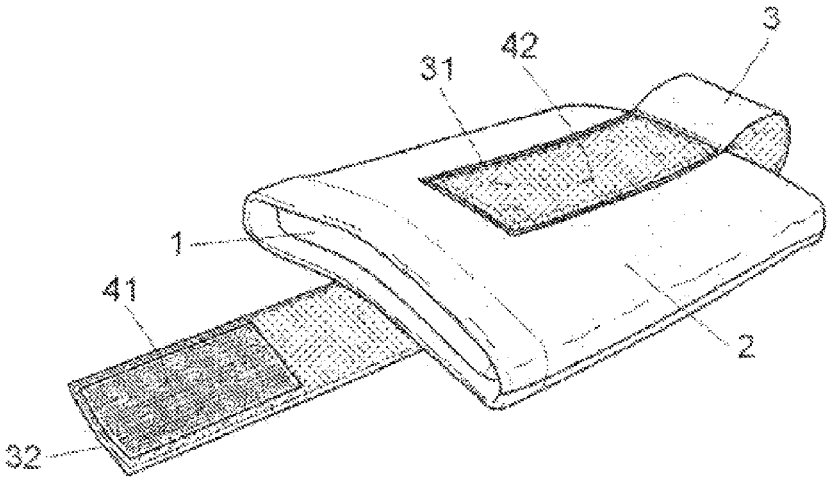
FIG. 2 shows a perspective view of the weighting device for footwear of the above figure with the plate made of heavy material received inside the flexible bag and with the strap folded under the bag allowing the adjustable closure means arranged at the free end of the strap and in the bag to be observed.

The device further comprises a flexible bag (2), in this case a fabric bag, provided with a mouth (21) for inserting the plate (1) therein as shown in FIG. 2.

This bag (2) is provided with means for attaching the weighting device to the footwear, said means being represented by a strap (3), in this case a textile strap, having a first end (31) fixed to the bag (2) and a second, free end (32).

The device comprises adjustable closure means (41, 42) in this case comprising two contact closure complementary halves, said adjustable closure means (41, 42) being arranged on the second, free end (32) of the strap (3) and on the surface of the bag (2), in this particular case in correspondence with the first end (31) of said strap (3).

Figure 3:
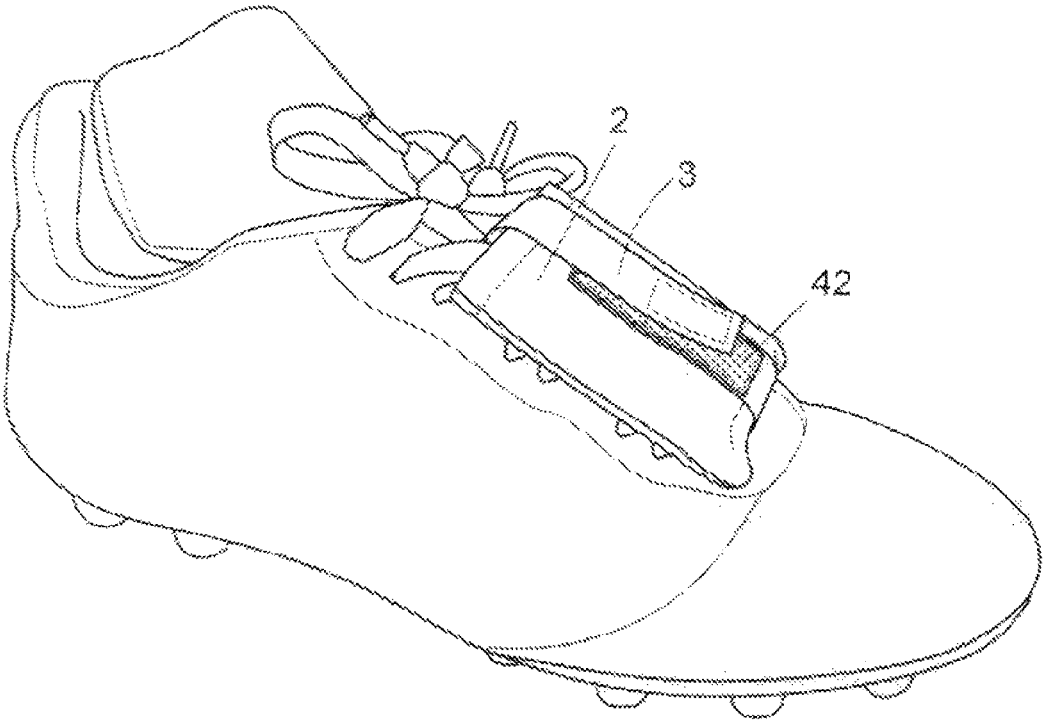
FIG. 3 shows a perspective view of the weighting device for footwear of the above figures in a position of use, arranged on the area of the instep of a football boot and attached by means of the strap over intersections of the lace for tying the boot.
Figure 4:
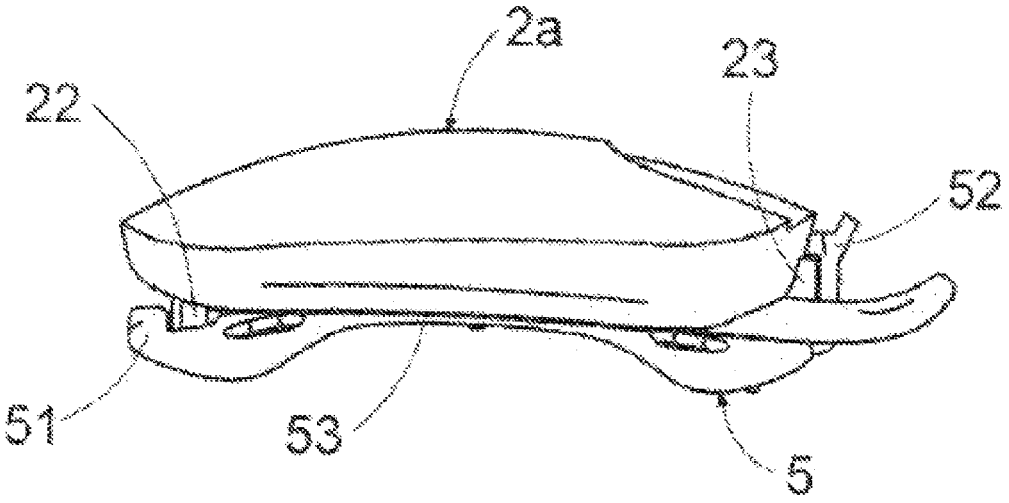
FIGS. 4 and 5 show respective lateral and front views of one variant of embodiment of the device of the invention where the receptacle for receiving the plate made of heavy material includes a semirigid casing.
Figure 5:
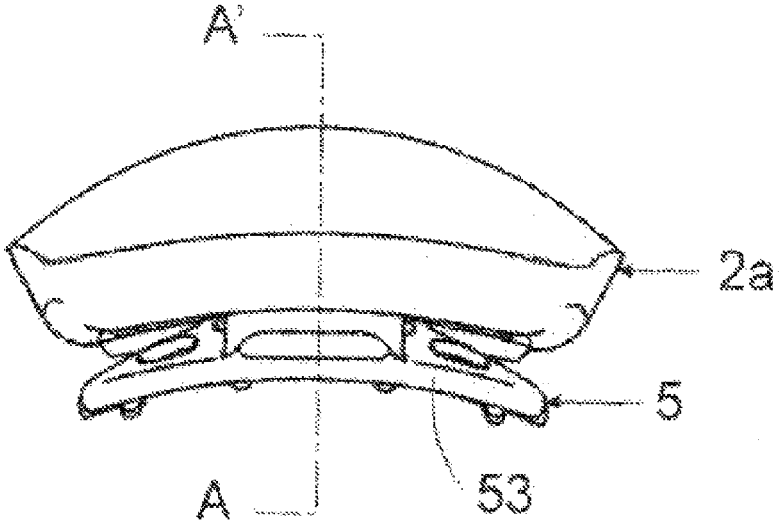
Figure 6:
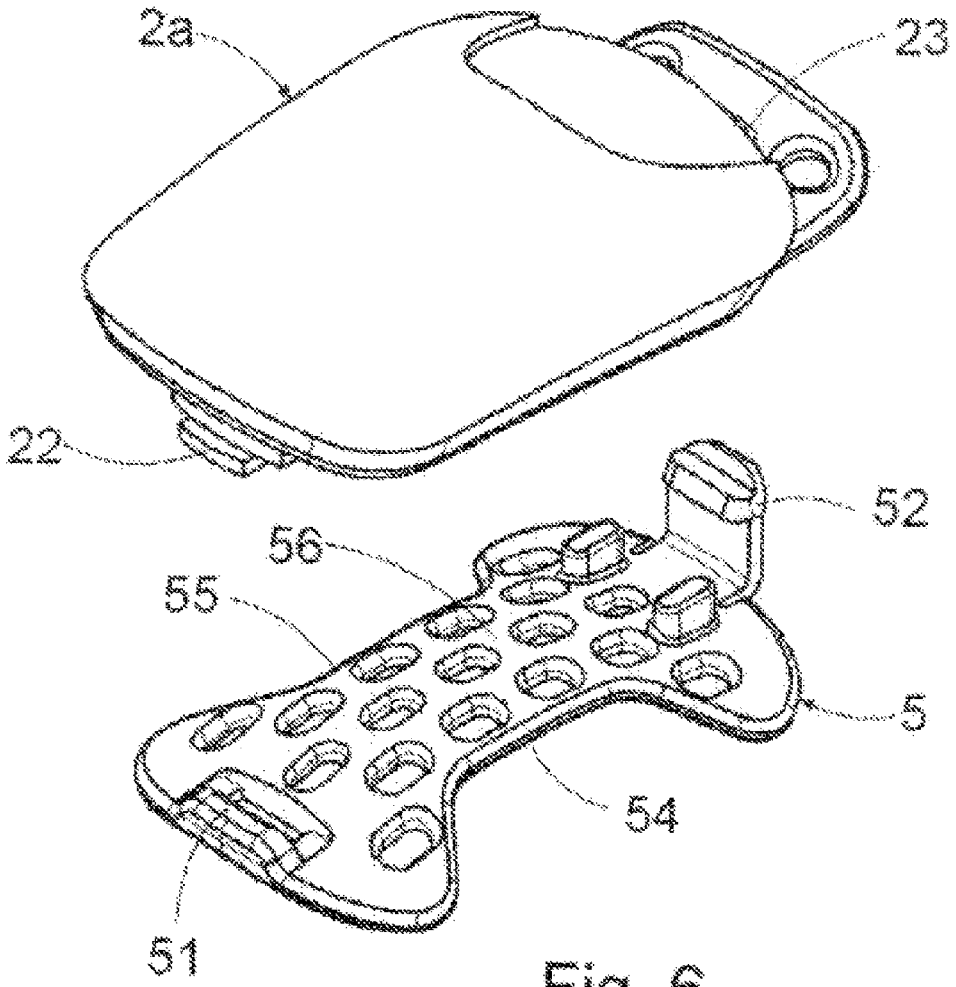
FIG. 6 shows a perspective exploded view of the device in FIGS. 4 and 5.
Figure 7:
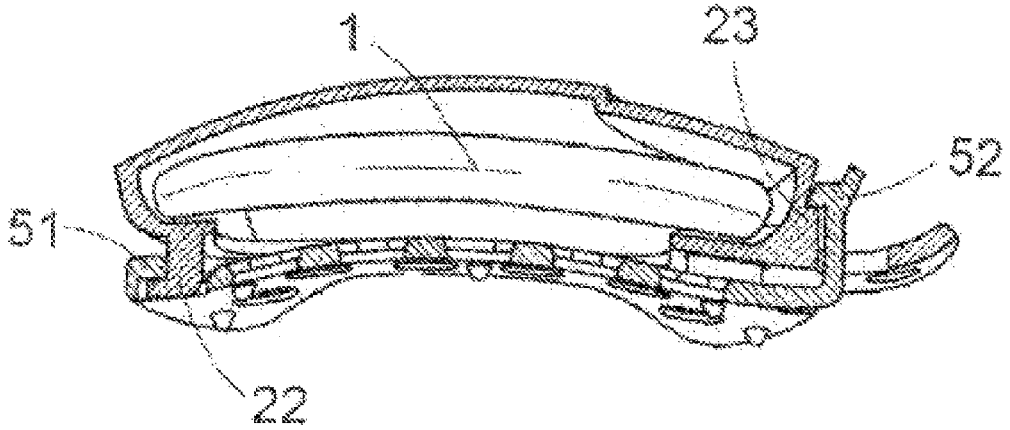
FIG. 7 corresponds to a vertical section of the device through the vertical plane A-A' shown in FIG. 5.

As it can be seen in FIG. 3, in the position of use the device is supported and adapted on the instep area of the footwear, the strap (3) having an appropriate orientation and length to be passed under the intersecting areas of the lace for tying the boot, said strap (3) forming a loop around said intersecting areas of the tying lace for and the bag (2) itself receiving the plate (1); the strap (3) being attached in said position by the interaction of the adjustable closure means (41, 42).

In this position of use, the device is prevented from being displaced, both in longitudinal direction and lateral direction, providing a greater wearing comfort to the user and preventing uncontrolled movements of the device.

In the variant of embodiment shown in FIGS. 4 to 7, the device comprises a receptacle for receiving the plate made of heavy material (1) comprising a semirigid casing (2*a*) inside of which the heavy material and a releasable mounting base (5) are received.

The casing (2*a*) and the releasable mounting base (5) are provided with complementary coupling and attaching means (22, 51) and (23, 52) at two opposite ends thereof in a coupling position.

The releasable mounting base has a curved outer surface (53) so as to adapt to the area of the instep of the footwear, and it comprises lateral recesses (54, 55), formed between two opposite ends carrying the coupling and attaching means (51, 52), defining in said releasable mounting base (5) an intermediate portion narrower than the opposite ends of said base and suitable for being positioned on the instep of the footwear, under the laces, being immobilized both from lateral movement and from longitudinal movement.

Having been sufficiently described the nature of the invention as well as one preferred embodiment, it is understood to all appropriate effects that the materials, shape, size and arrangement of the elements described herein can be modified, provided that this entails no modification of the essential features of the invention claimed hereinbelow.

The invention claimed is:

1. A weighting device for attachment to a footwear comprising an instep area and laces, and for one or both sports training or rehabilitation therapies, the weighting device comprising:

a weighting plate with a curved shape for resting on the instep area of the footwear, and a receptacle, the receptacle comprising a casing for the arrangement of said weighting plate therein, and a releasable mounting base to be placed under the laces of the footwear to be weighted and retained by the laces and having a curved outer surface so as to adapt to the area of the instep of the footwear, the casing and the releasable mounting base being provided with complementary couplings, such that the casing is arranged over the laces of the footwear to which the weighting device is attachable and the complementary couplings between the casing and the releasable mounting base being provided at two opposite ends thereof, and the releasable mounting base comprises lateral recesses formed between the two opposite ends carrying the couplings and defining in said releasable mounting an intermediate portion narrower than the opposite ends.

2. A weighting device according to claim 1, the plate being rectangular.

3. A system for sports training or rehabilitation therapies, comprising:

a footwear comprising an instep area and laces, and a weighting device for weighting the footwear, the weighting device comprising:

a weighting plate with a curved shape for resting on the instep area of the footwear, and a receptacle, the receptacle comprising a casing for the arrangement of said plate therein, and a releasable mounting base to be placed under the laces of the footwear to be weighted and retained by the laces and having a curved outer surface so as to adapt to the area of the instep of the footwear, and the casing and the releasable mounting base being provided with complementary couplings, such that the casing is arranged over the laces.

4. The system according to claim 3, the plate being rectangular.

5. The system according to claim 3, the complementary couplings between the casing and the releasable mounting base being provided at two opposite ends thereof.

6. The system according to claim 5, the releasable mounting base comprising lateral recesses, formed between the two opposite ends carrying the couplings and defining in said releasable mounting an intermediate portion narrower than the opposite ends.

* * * * *